US008428493B2

(12) United States Patent
Mase

(10) Patent No.: US 8,428,493 B2
(45) Date of Patent: Apr. 23, 2013

(54) IMAGE FORMING APPARATUS

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 278 days.

(21) Appl. No.: 13/010,816

(22) Filed: Jan. 21, 2011

(65) Prior Publication Data

US 2011/0176832 A1 Jul. 21, 2011

(30) Foreign Application Priority Data

Jan. 21, 2010 (JP) ..... 2010-011376

(51) Int. Cl.
*G03G 15/00* (2006.01)
*G03G 15/16* (2006.01)

(52) U.S. Cl.
USPC ..... 399/167; 399/66

(58) Field of Classification Search ..... 399/167, 399/314, 66
See application file for complete search history.

(56) References Cited

U.S. PATENT DOCUMENTS

| | | | | |
|---|---|---|---|---|
| 7,720,399 | B2 * | 5/2010 | Takahashi | 399/66 |
| 8,185,007 | B2 * | 5/2012 | Tsukamura et al. | 399/66 |
| 2007/0110482 | A1 | 5/2007 | Kazaki et al. | |

FOREIGN PATENT DOCUMENTS

| | | | |
|---|---|---|---|
| JP | 2000-313568 | A | 11/2000 |
| JP | 2006-330295 | A | 12/2006 |
| JP | 2007-140062 | A | 6/2007 |

* cited by examiner

*Primary Examiner* — Susan Lee
(74) *Attorney, Agent, or Firm* — Baker Botts L.L.P.

(57) ABSTRACT

An image forming apparatus includes: a photosensitive drum; a development roller; a transfer roller; a drum driving unit that includes a forwardly and reversely rotatable motor; a forward transport unit; a reverse transport unit; and a transfer potential control unit that is configured to control a surface potential of the transfer roller to have a reverse polarity to that of the developer on the photosensitive drum during the forward rotation of the motor and control the surface potential of the transfer roller to be a potential that has the same polarity as the developer on the photosensitive drum and is equal to or higher than a surface potential of the photosensitive drum during the reverse rotation of the motor.

6 Claims, 4 Drawing Sheets

IMAGE FORMING APPARATUS

CROSS REFERENCE TO RELATED APPLICATION

The present application claims priority from Japanese Patent Application No. 2010-011376, which was filed on Jan. 21, 2010, the disclosure of which is herein incorporated by reference in its entirety.

TECHNICAL FIELD

The present invention relates to an electrophotographic image forming apparatus.

BACKGROUND

In an electrophotographic image forming apparatus, an electrostatic latent image is formed on a circumferential surface of a photosensitive drum as the photosensitive drum is rotated, and then toner is supplied from a development roller to the circumferential surface of the photosensitive drum. Accordingly, the electrostatic latent image is developed into a toner image, and the toner image is coated on the circumferential surface of the photosensitive drum. On the downstream side in a rotating direction of the photosensitive drum against the development roller, a transfer roller is oppositely arranged on the photosensitive drum. At the time the toner image coated on the circumferential surface of the photosensitive drum comes to be opposite to the circumferential surface of the transfer roller as the photosensitive drum is rotated, a paper is supplied between the photosensitive drum and the transfer roller. Also, by the action of a bias applied to the transfer roller, the toner image is transferred from the circumferential surface of the photosensitive drum onto the paper to form an image (toner image) on the paper.

In the image forming apparatus as described above, a so-called double-sided mode is provided, in which an image is formed on one surface of a paper, the paper is transported with its sides reversed, and then an image is formed on the other side that is the reverse of the one surface of the paper.

In the image forming apparatus having the double-sided mode, for example, there are installed a main transport path for transporting a paper up to a paper discharge port via an image forming portion having a photosensitive drum provided therein, and a sub-transport path for sending the paper, on one surface of which an image is formed by the image forming portion, to the image forming portion with the sides of the paper reversed.

Rollers, which are provided in the photosensitive drum, the main transport path, and the sub-transport path, are rotated, for example, by an output of a single reversible motor. That is, by the output of forward rotation of the reversible motor, the photosensitive drum is rotated, and the respective rollers in the main transport path are rotated. Accordingly, the paper is transported to the main transport path, and a toner image is transferred from the photosensitive drum to the paper. On the other hand, by the output of reverse rotation of the reversible motor, the respective rollers in the sub-transport path are rotated, and the paper is transported to the sub-transport path. From the viewpoint of suppressing deterioration of the photosensitive drum, for example, a clutch is installed between the reversible motor and the photosensitive drum, and during the reverse rotation of the reversible motor, the connection between the reversible motor and the photosensitive drum is released by the clutch.

SUMMARY

While the paper is being transported to the sub-transport path, the paper is not transported to the main transport path, and thus even if the output of the reverse rotation of the reversible motor is delivered to the photosensitive drum and the respective rollers in the main transport path, it has no effect on the transport of the paper. Accordingly, by omitting the clutch and making the output of the reverse rotation of the reversible motor delivered to the photosensitive drum, the construction of the image forming apparatus can be simplified.

However, when the toner attached to the circumferential surface of the photosensitive drum comes to be opposite to the transfer roller by the rotation of the photosensitive drum, the toner may be transferred from the circumferential surface of the photosensitive drum to the circumferential surface of the transfer roller. If the toner is attached to the transfer roller, the toner is transferred from the transfer roller to the paper when the paper is transported to the main transport path, and thus the paper gets dirty.

An advantage of some aspects of the invention is to provide an image forming apparatus that can prevent the transfer of toner from the circumferential surface of a photosensitive drum to the circumferential surface of a transfer roller.

According to an illustrative aspect of the present invention, there is provided an image forming apparatus comprising: a photosensitive drum; a development roller that is provided so that a circumferential surface of the development roller comes into contact with a circumferential surface of the photosensitive drum to supply a developer to the circumferential surface of the photosensitive drum; a transfer roller that is provided so that a circumferential surface of the transfer roller is opposite to the circumferential surface of the photosensitive drum to transfer a development image, which is formed on the circumferential surface of the photosensitive drum by a supply of the developer from the development roller, from the circumferential surface of the photosensitive drum to a sheet; a drum driving unit that includes a forwardly and reversely rotatable motor to forwardly rotate the photosensitive drum by an output during a forward rotation of the motor and to reversely rotate the photosensitive drum by an output during a reverse rotation of the motor; a forward transport unit that transports the sheet along a transport path that is opposite to the circumferential surface of the photosensitive drum by the output during the forward rotation of the motor; a reverse transport unit that transports the sheet having one surface to which the developer image has been transferred along a reverse transport path, by the output during the reverse rotation of the motor, and sending the sheet to the transport path with the one surface and the other surface of the sheet reversed to have a posture that the other surface of the sheet is opposite to the circumferential surface of the photosensitive drum on the transport path; and a transfer potential control unit that is configured to control a surface potential of the transfer roller to have a reverse polarity to that of the developer on the photosensitive drum during the forward rotation of the motor and control the surface potential of the transfer roller to be a potential that has the same polarity as the developer on the photosensitive drum and is equal to or higher than a surface potential of the photosensitive drum during the reverse rotation of the motor.

According to the illustrative aspect of the present invention, the photosensitive drum and the development roller are installed so that their circumferential surfaces are in contact with each other. Also, the transfer roller is installed so that its circumferential surface is opposite to the circumferential surface of the photosensitive drum.

By the output of forward rotation of the motor, the photosensitive drum is rotated forwardly, and a sheet is transported along the transport path. Also, during the forward rotation of the motor, the surface potential of the transfer roller is controlled to have a reverse polarity to the developer on the photosensitive drum. Accordingly, the developer image formed on the circumferential surface of the photosensitive drum is transferred to the sheet while the sheet passes between the photosensitive drum and the transfer roller.

On the other hand, by the output of reverse rotation of the motor, the photosensitive drum is rotated reversely, and the sheet, on one surface of which an image is formed, is sent to the transport path through the reverse transport path. During the reverse rotation of the motor, the surface potential of the transfer roller has the same polarity as the developer on the photosensitive drum, and is controlled to become an equal to higher potential than a surface potential of the photosensitive drum. Accordingly, the transfer of the toner from the circumferential surface of the photosensitive drum to the circumferential surface of the transfer roller can be prevented.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, embodiments of the present invention will be described in detail with reference to the accompanying drawings.

1. The Entire Construction of a Printer

Figure 1:
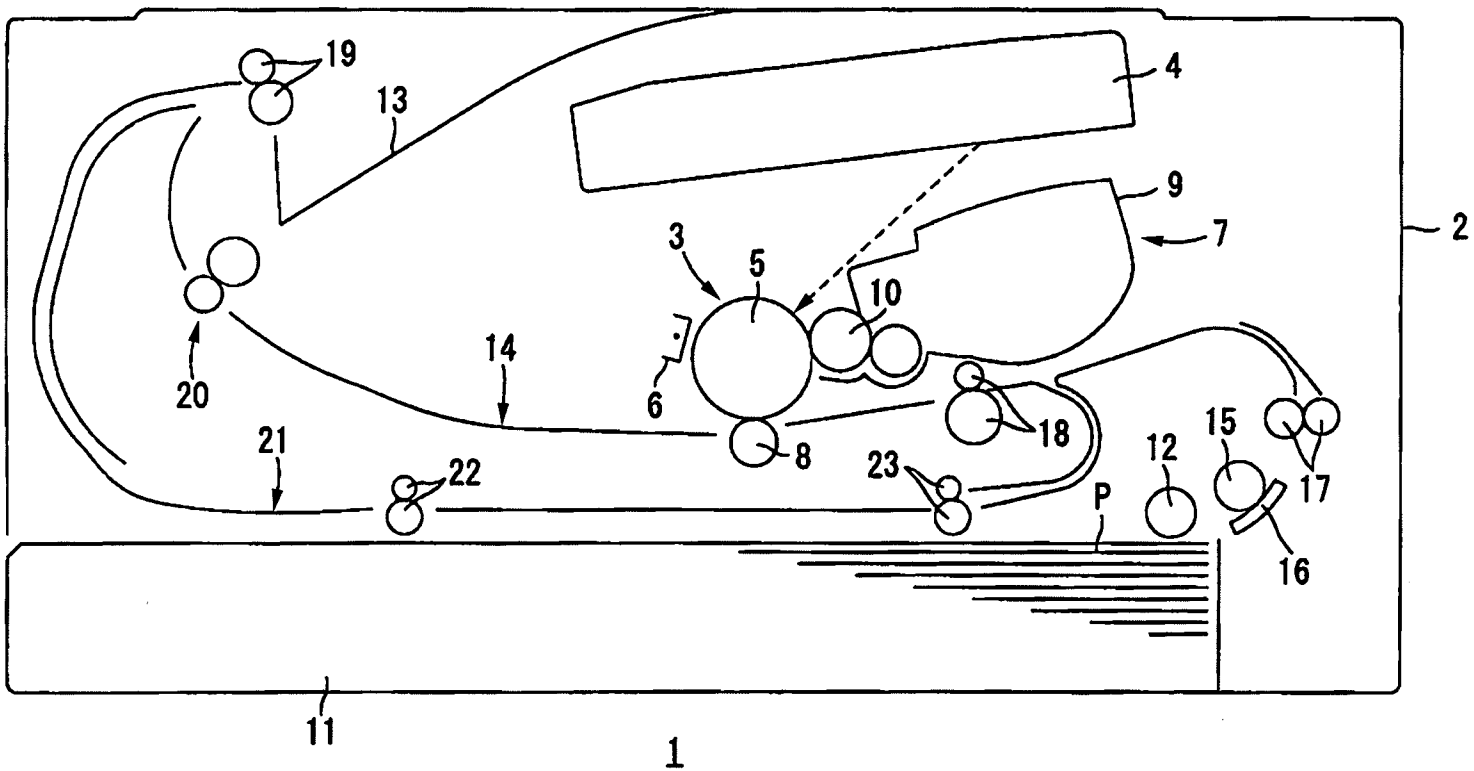
FIG. 1 is a cross-sectional view of a printer according to an embodiment of the present invention.

As illustrated in FIG. 1, a printer 1, which is an example of an image forming apparatus, is provided with a main body casing 2. In the center portion of the interior of the main body casing 2, a process portion 3 is installed. On the upper side of the process portion 3, an exposure system 4 having a laser and so on is arranged.

The process portion 3 includes a photosensitive drum 5, a charger 6, a developer 7, and a transfer roller 8.

The photosensitive drum 5 is rotatably installed around an axis line that extends in a direction perpendicular to a ground surface of FIG. 1.

The charger 6 is a scorotron type charger, and is arranged opposite to the circumferential surface of the photosensitive drum 5 at a predetermined interval.

The developer 7 includes a development housing 9 accommodating toner, and a development roller 10 rotatably maintained on the development housing 9. The toner accommodated in the development housing 9 is a toner having ester resin as its main component. A portion of the circumferential surface of the development roller 10 is exposed from the development housing 9. Also, the developer 7 is arranged so that the circumferential surface of the development roller 10 is in contact with the circumferential surface of the photosensitive drum 5.

Below the photosensitive drum 5, the transfer roller 8 is rotatably installed around the axis line that is parallel to the rotating axis line of the photosensitive drum 5, and is arranged so that the circumferential surface of the transfer roller 8 is in contact with the circumferential surface of the photosensitive drum 5.

During the image forming operation, the photosensitive drum 5 is rotated at constant speed clockwise as shown in FIG. 1. As the photosensitive drum 5 is rotated, the circumferential surface (surface) of the photosensitive drum 5 is uniformly positive-charged due to the discharge operation of the charger 6. On the other hand, based on image data that is received from a personal computer (not illustrated) connected to the printer 1, laser beams are emitted from the exposure system 4. The laser beams are applied to the uniformly positive-charged circumferential surface of the photosensitive drum 5 through the charger 6 and a developer 7. Accordingly, the circumferential surface of the photosensitive drum 5 is selectively exposed, and charge is selectively removed from the exposed portion, resulting in an electrostatic latent image being formed on the circumferential surface of the photosensitive drum 5. Also, if the electrostatic latent image comes to be opposite to the development roller 10 by the rotation of the photosensitive drum 5, positively charged toner is supplied from the development roller 10 to the electrostatic latent image. Accordingly, a toner image is formed on the circumferential surface of the photosensitive drum 5.

On a bottom portion of the main body casing 2, a feed cassette 11 accommodating paper P is arranged. On the upper side of the feed cassette 11, a pickup roller 12 for sending the paper from the feed cassette 11 is installed.

Also, inside the main body casing 2, as seen from the side, an "S"-shaped transport path 14 is formed. This transport path 14 extends from the feed cassette 11 to a paper discharge tray 13 formed on an upper surface of the main body casing 2 through the photosensitive drum 5 and the transfer roller 8. On the transport path 14, a separation roller 15 and a separation pad 16 which are arranged opposite to each other, a pair of feed rollers 17, a pair of resist rollers 18, and a pair of paper discharge rollers 19 are installed.

The paper P sent from the feed cassette 11 is released one by one, passing through the separation roller 15 and the separation pad 16. Thereafter, the paper P is transported toward the resist rollers 18 by the feed rollers 17. After resist by the resist rollers 18, the paper P is transported between the photosensitive drum 5 and the transfer roller 8 by the resist roller 18.

The toner image on the circumferential surface of the photosensitive drum 5 is transferred to the paper P when the toner image comes to be opposite to the paper P that passes between the photosensitive drum 5 and the transfer roller 8 by the rotation of the photosensitive drum 5.

On the transport path 14, a fuser 20 is installed on the downstream side in the transport direction of the paper P against the transfer roller 8. The paper P, on which the toner image has been transferred, is transported to the transport path 14, and then passes through the fuser 20. The fuser 20 makes the toner image into an image by heating and pressing, and fuses the image on the paper P.

The printer 1 adopts a cleanerless type, and after the toner image is transferred to the paper P, the toner that remains on the circumferential surface of the photosensitive drum 5 is pulled onto the circumferential surface of the development roller 10 to be withdrawn when the toner comes to be opposite to the development roller 10 by the rotation of the photosensitive drum 5.

Also, the printer 1 has an operation mode that is divided into a single-sided mode in which an image (toner image) is formed on one surface of the paper P, and a double-sided mode in which an image is formed on one surface of the paper P, and then the image is formed on the other side that is opposite to the one surface of the paper P.

In the single-sided mode, the paper P, on one side of which the image has been formed, is discharged to the paper discharge tray 13 by the paper discharge roller 19.

As a construction for realizing the double-sided mode, a reverse transport path 21 is formed inside the main body casing 2. The reverse transport path 21 extends from the neighborhood of the paper discharge roller 19 and between the transport path 14 and the feed cassette 11, and is connected with a portion between the feed roller 17 and the resist roller 18 on the transport path 14. On the reverse transport path 21, a pair of first reverse transport rollers 22 and a pair of second reverse transport rollers 23 are installed.

In the double-sided mode, after an image is formed on one side of the paper P, the paper P is not discharged to the paper discharge tray 13, but is sent to the reverse transport path 21. Then, the paper P is transported to the reverse transport path 21 by the first reverse transport rollers 22 and the second reverse transport rollers 23, and then is sent to the transport path 14 with its sides reversed so that the other surface, on which no image is formed, has a position that is opposite to the circumferential surface of the photosensitive drum 5. Accordingly, the image is formed on the other surface of the paper P to form the image on both surfaces of the paper P.

2. Electrical Configuration of Printer

Figure 2:
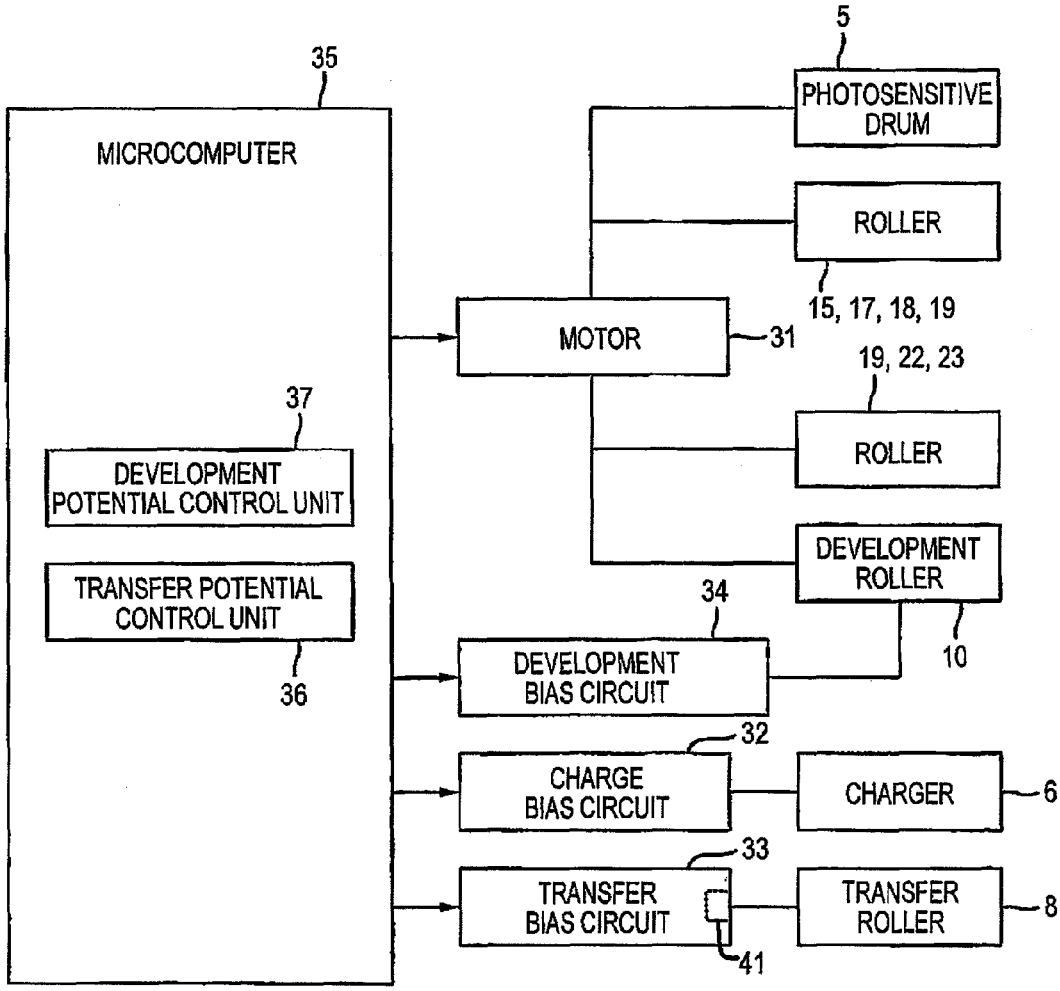
FIG. 2 is a block diagram illustrating the electrical configuration of the printer.

As illustrated in FIG. 2, the printer 1 is provided with a motor 31 as an example of a drum driving unit. The motor 31 is a motor that can be rotated forwardly and reversely.

By the output of forward rotation of the motor 31, the photosensitive drum 5 is rotated forwardly in a rotating direction during the development of the electrostatic latent image (clockwise direction in FIG. 1). Also, by the output of forward rotation of the motor 31, the separation roller 15, the feed rollers 17, the resist rollers 18, and the paper discharge rollers 19 are rotated as an example of a forward transport unit on the transport path 14. By the rotation of the separation roller 15, the feed rollers 17, the resist rollers 18, and the paper discharge rollers 19, the paper P is transported along the transport path 14.

By the output of reverse rotation of the motor 31, the photosensitive drum 5 is rotated reversely in an opposite direction to the forward rotation (counterclockwise direction in FIG. 1). Also, by the output of reverse rotation of the motor 31, the paper discharge rollers 19, the first reverse transport rollers 22 and the second reverse transport rollers 23 on the reverse transport path 21 are rotated as an example of a reverse transport unit. By the rotation of the first reverse transport rollers 22 and the second reverse transport rollers 23, the paper P is transported along the reverse transport path 21. Also, the rotating direction of the paper discharge rollers 19 is reverse to the rotating direction by the output of forward rotation of the motor 31.

Also, the printer 1 includes a charge bias circuit 32 for applying a charge bias (a wire bias and a grid bias) to the charger 6, a transfer bias circuit 33 as an example of a transfer bias applying unit for applying a transfer bias to the transfer roller 8, and a development bias circuit 34 for applying a development bias to the development roller 10.

Also, the printer 1 is provided with a microcomputer 35. The microcomputer 35, as a hardware configuration, includes a CPU, a memory, and the like. Also, as a configuration that is realized by software through a program processed by the CPU, the microcomputer 35 actually includes a transfer potential control unit 36 as an example of a transfer potential control unit that controls the surface potential of the transfer roller 8, and a development potential control unit 37 as an example of a development potential control unit that controls the surface potential of the development roller.

The motor 31, the charge bias circuit 32, the transfer bias circuit 33, and the development bias circuit 34 are connected to the microcomputer 35 as objects to be controlled.

3. Surface Potential Control

Figure 3:
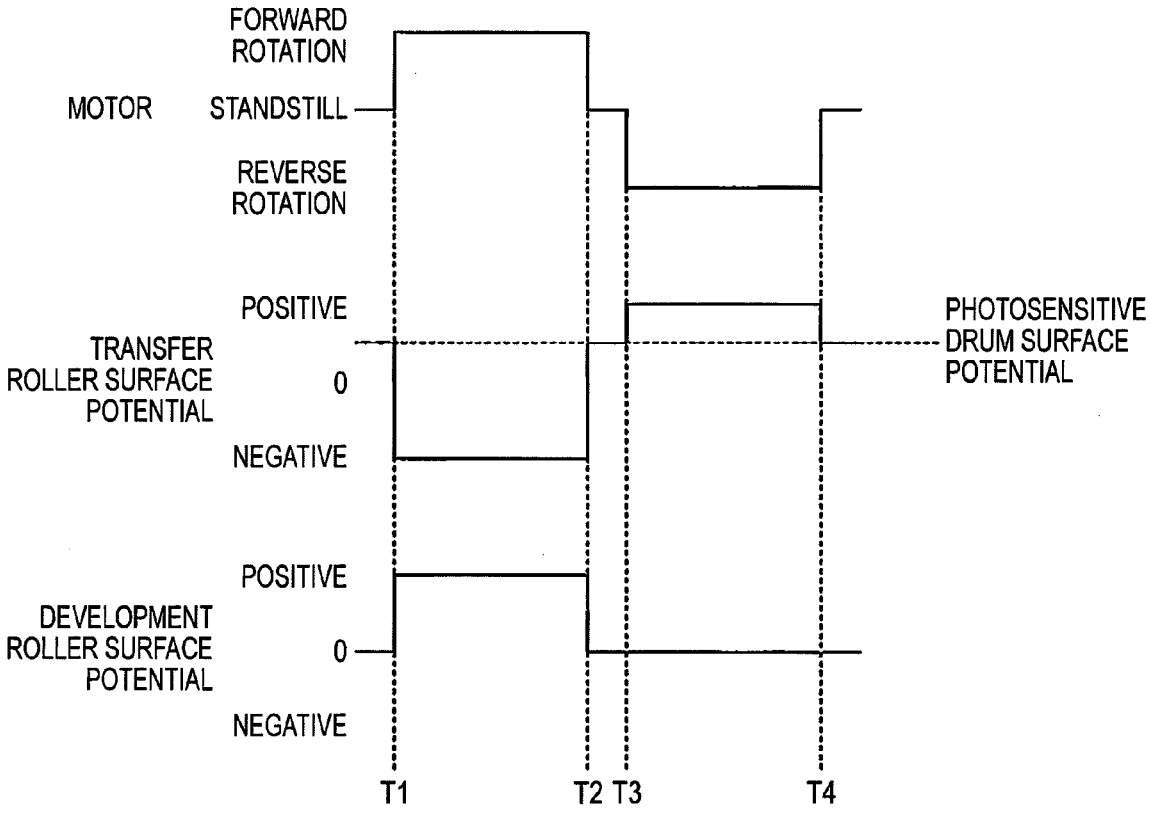
FIG. 3 is a timing chart illustrating one technique of controlling the surface potentials of a transfer roller and a development roller.

As illustrated in FIG. 3, during the forward rotation of the motor 31, that is, when the paper P is transported along the transport path 14, the transfer bias circuit 33 is controlled by the transfer potential control unit 36, and a negative transfer bias (for example, −1000V) is applied from the transfer bias circuit 33 to the transfer roller 8.

Also, the development bias circuit 34 is controlled by the development potential control unit 37, and a positive development bias (for example, +300V) is applied from the development bias circuit 34 to the development roller 10.

The charge bias circuit 32 is controlled by the microcomputer 35, and a charge bias is applied from the charge bias circuit 32 to the charger 6. As the charge bias is applied to the charger 6, the charger 6 is discharged, and a constant positive potential (for example, +800V) is charged on the circumferential surface of the photosensitive drum 5.

If laser beams are applied from the exposure system 4 to the circumferential surface of the photosensitive drum 5, charge vanishes from the exposed portion to which the laser beams are applied. Accordingly, the circumferential surface of the photosensitive drum 5 is selectively exposed, and a latent image (an electrostatic latent image) due to the existence/nonexistence of charge is formed on the circumferential surface of the photosensitive drum 5. Also, as the charge is selectively removed, the surface potential of the exposed portion becomes lower than the development bias that is applied to the development roller 10. Because of this, the positive-polarity toner that is coated on the circumferential surface of the development roller 10 is pulled and transferred by an electrostatic force to the exposed portion when the toner comes to be opposite to the exposed portion of the circumferential surface of the photosensitive drum 5. Accordingly, development of the electrostatic latent image is achieved by the toner, and a toner image is formed on the circumferential surface of the photosensitive drum 5.

Thereafter, if the toner image, which is positively charged, comes to be opposite to the transfer rollers 8, between which the paper P is inserted, by the rotation of the photosensitive drum 5, the toner image is pulled to the transfer rollers 8, to which the negative transfer bias is applied, by the electrostatic force. Accordingly, the toner image is transferred from the circumferential surface of the photosensitive drum 5 to the paper P.

On the other hand, if the paper P, on one surface of which an image is formed, is transported along the reverse transport path 21 during the reverse rotation of the motor 31, the transfer bias circuit 33 is controlled by the transfer potential control unit 36, and thus a positive transfer bias is applied from the transfer bias circuit 33 to the transfer roller 8. At this time, the transfer bias has the same polarity as that of the toner remaining on the circumferential surface of the photosensitive drum 5, and is set to an equal to higher potential level that a surface potential of the photosensitive drum 5 (for example, +1500V). The charge bias circuit 32 is controlled by the microcomputer 35, and the same charge bias as that during the forward rotation of the motor 31 is applied to the charger 6. Because of this, the potential of the toner on the circumferential surface of the photosensitive drum 5 becomes almost the same as the surface potential of the photosensitive drum 5, which is uniformly positive-charged by the discharge from the charger 6.

By the transfer bias applied to the transfer roller 8, the surface potential of the transfer roller 8 has the same polarity as the toner on the circumferential surface of the photosensitive drum 5, and is controlled to be an equal to higher potential than a surface potential of the photosensitive drum 5. Because of this, when the toner remaining on the circumferential surface of the photosensitive drum 5 comes to be opposite to the transfer roller 8 by the reverse rotation of the photosensitive drum 5, electrostatic forces which are repulsive forces that repel each other act between the toner and the transfer roller 8. Accordingly, the transfer of the toner from the circumferential surface of the photosensitive drum 5 to the circumferential surface of the transfer roller 8 can be prevented.

Also, during the reverse rotation of the motor 31, the development bias circuit 34 is controlled by the development potential control unit 37, and thus the applying of the development bias from the development bias circuit 34 to the development roller 10 is stopped. Accordingly, in control, the surface potential of the development roller 10 becomes 0V, but in effect, because of the influence of the toner coated on the surface of the development roller 10, the surface potential of the development roller 10 becomes a very low positive potential.

Accordingly, the surface potential of the development roller 10 becomes lower than the surface potential of the photosensitive drum 5, and thus the transfer of the toner from the development roller 10 to the circumferential surface of the photosensitive drum 5 can be prevented. As a result, in a development area, the transfer of the toner to the photosensitive drum 5 (so-called pressure fog) scarcely occurs, and thus the transfer of the toner from the circumferential surface of the photosensitive drum 5 to the circumferential surface of the transfer roller 8 can be further prevented.

Also, the toner, which has ester resin as its main component, is positively charged by friction charging. Because of this, during the reverse rotation of the motor 31, deterioration of the surface potential of the photosensitive drum 5 can be suppressed.

Also, in the printer 1 that adopts a cleanerless type, during the forward rotation of the motor 31, the toner that remains on the circumferential surface of the photosensitive drum 5 after the transfer of the toner image onto the paper P is withdrawn by the development roller 10. Because of this, it is not necessary to separately install a cleaning mechanism (cleaning brush, cleaning roller, and the like) for withdrawing the toner that remains on the circumferential surface of the photosensitive drum 5. As a result, the construction of the printer 1 can be simplified. Further, unless the cleaning mechanism is installed, the toner is not transferred from the cleaning mechanism to the circumferential surface of the photosensitive drum 5 during the reverse rotation of the motor 31. Accordingly, the amount of toner attachment to the circumferential surface of the photosensitive drum 5 can be reduced, and thus the transfer of the toner from the circumferential surface of the photosensitive drum 5 to the circumferential surface of the transfer roller 8 can be further prevented.

Further, in the direction of the reverse rotation of the photosensitive drum 5, since the charger 6 is arranged adjacent to a portion through which laser beams that are applied from the exposure system 4 to the photosensitive drum 5 passes, deterioration of the surface potential can be immediately solved even if deterioration of the surface potential due to dark exposure occurs on the circumferential surface of the photosensitive drum 5 during the reverse rotation of the motor 31 (reverse rotation of the photosensitive drum 5). Also, in the case of adopting a construction that stops the photosensitive drum 5 instead of reversely rotating the photosensitive drum 5, the laser beams, which are applied from the exposure system 4 to the photosensitive drum 5, scan the same portion of the surface of the photosensitive drum 5. In this case, a portion of which the potential is considerably lowered may occur on the photosensitive drum 5 to exert a bad effect on the image. In this embodiment, this problem can also be solved.

4. Second Embodiment

As described above, by applying a bias, which has the same polarity as the toner on the circumferential surface of the photosensitive drum 5 and has an equal to higher potential than a surface potential of the photosensitive drum 5, from the transfer bias circuit 33 to the transfer roller 8, the surface potential of the transfer roller 8 can be controlled to be a potential which has the same polarity as the toner on the circumferential surface of the photosensitive drum 5 and is equal to or higher than a surface potential of the photosensitive drum 5.

However, the method of controlling the surface potential of the transfer roller 8 is not limited thereto. For example, as indicated by a dashed line in FIG. 2, by disconnecting a relay 41, which is installed to disconnect the electrical connection between the transfer roller 8 and the transfer bias circuit 33, the surface potential of the transfer roller 8 can be controlled to be a potential which has the same polarity as the toner on the circumferential surface of the photosensitive drum 5 and has almost the same level as the surface potential of the photosensitive drum 5.

Figure 4:
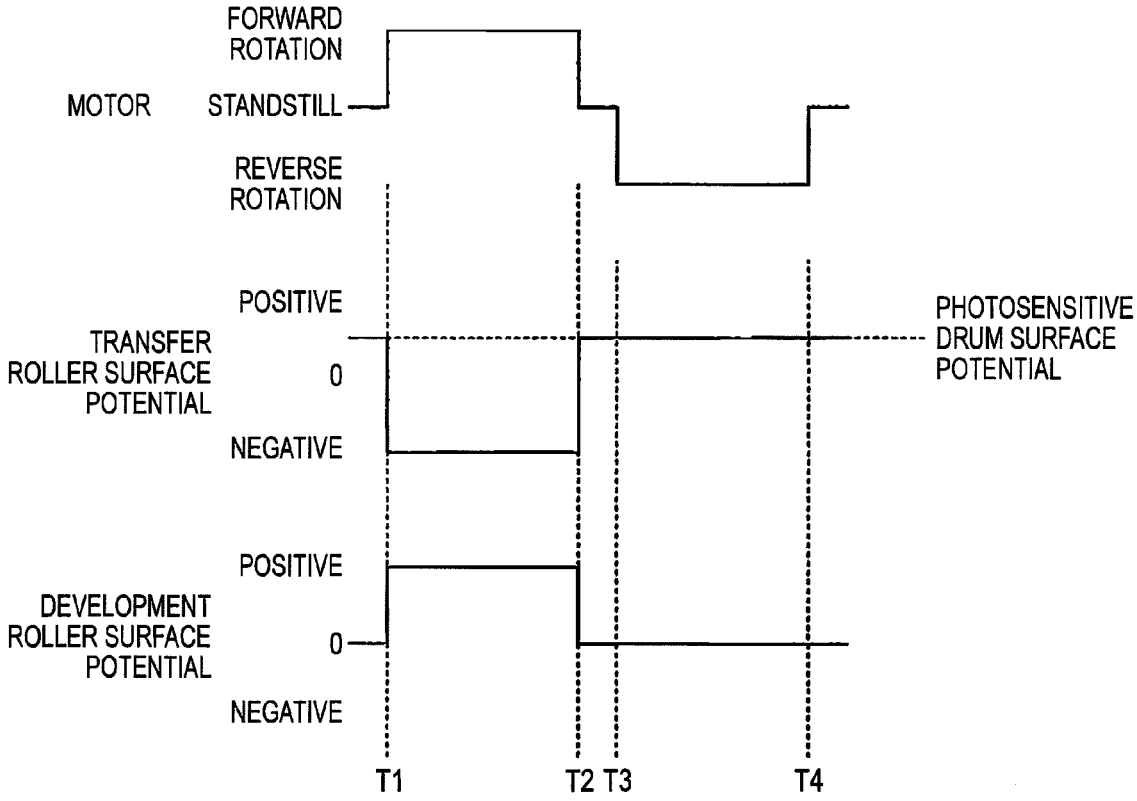
FIG. 4 is a timing chart illustrating another technique (second embodiment) of controlling the surface potentials of a transfer roller and a development roller.

If the electrical connection between the transfer roller 8 and the transfer bias circuit 33 is disconnected during the reverse rotation of the motor 31, the transfer roller 8 comes to be in an electrically open state, and thus the surface potential of the transfer roller 8 becomes almost the same as the surface potential of the photosensitive drum 5 as illustrated in FIG. 4. By doing this, the surface potential of the transfer roller 8 can also be controlled to be a potential which has the same polarity as the toner on the circumferential surface of the photosensitive drum 5 and has almost the same level as the surface potential of the photosensitive drum 5. As a result, the transfer of the toner from the circumferential surface of the photosensitive drum 5 to the circumferential surface of the transfer roller 8 can be presented.

5. Modified Example

The present invention is not limited to a monochrome printer, and can also be applied to a color printer.

What is claimed is:

1. An image forming apparatus comprising:

a photosensitive drum;

a development roller that is provided so that a circumferential surface of the development roller comes into contact with a circumferential surface of the photosensitive drum to supply a developer to the circumferential surface of the photosensitive drum;

a transfer roller that is provided so that a circumferential surface of the transfer roller is opposite to the circumferential surface of the photosensitive drum to transfer a development image, which is formed on the circumferential surface of the photosensitive drum by a supply of the developer from the development roller, from the circumferential surface of the photosensitive drum to a sheet;

a drum driving unit that includes a forwardly and reversely rotatable motor to forwardly rotate the photosensitive drum by an output during a forward rotation of the motor and to reversely rotate the photosensitive drum by an output during a reverse rotation of the motor;

a forward transport unit that transports the sheet along a transport path that is opposite to the circumferential surface of the photosensitive drum by the output during the forward rotation of the motor;

a reverse transport unit that transports the sheet having one surface to which the developer image has been transferred along a reverse transport path, by the output during the reverse rotation of the motor, and sending the sheet to the transport path with the one surface and the other surface of the sheet reversed to have a posture that the other surface of the sheet is opposite to the circumferential surface of the photosensitive drum on the transport path; and a transfer potential control unit that is configured to control a surface potential of the transfer roller to have a reverse polarity to that of the developer on the photosensitive drum during the forward rotation of the motor and control the surface potential of the transfer roller to be a potential that has the same polarity as the developer on the photosensitive drum and is equal to or higher than a surface potential of the photosensitive drum during the reverse rotation of the motor.

2. The image forming apparatus according to claim 1, further comprising a transfer bias applying unit that is configured to apply a bias to the transfer roller;

wherein the transfer potential control unit controls the transfer bias applying unit to apply a bias, which has the same polarity as the developer on the photosensitive drum and has a higher potential than a surface potential of the photosensitive drum, to the transfer roller during the reverse rotation of the motor.

3. The image forming apparatus according to claim 1, further comprising a transfer bias applying unit that is configured to apply a bias to the transfer roller;

wherein the transfer potential control unit disconnects an electrical connection between the transfer roller and the transfer bias applying unit during the reverse rotation of the motor.

4. The image forming apparatus according to claim 1, further comprising:

a charging unit that is configured to positively or negatively charge the circumferential surface of the photosensitive drum during the reverse rotation of the motor; and a development potential control unit that is configured to control the surface potential of the development roller to be 0V during the reverse rotation of the motor.

5. The image forming apparatus according to claim 1, wherein the developer is a toner composed of ester resin as its main component.

6. The image forming apparatus according to claim 1, wherein the development roller withdraws the developer, which remains on the circumferential surface of the photosensitive drum after the transfer of the developer image to the sheet, during the forward rotation of the motor.

* * * * *